US006986718B2

(12) United States Patent
Ohama et al.

(10) Patent No.: US 6,986,718 B2
(45) Date of Patent: Jan. 17, 2006

(54) MULTI-PIECE SOLID GOLF BALL

(75) Inventors: Keiji Ohama, Kobe (JP); Seiichiro Endo, Kobe (JP)

(73) Assignee: SRI Sports Limited, Kobe (JP)

( * ) Notice: Subject to any disclaimer, the term of this patent is extended or adjusted under 35 U.S.C. 154(b) by 131 days.

(21) Appl. No.: 10/186,610

(22) Filed: Jul. 2, 2002

(65) Prior Publication Data

US 2003/0109332 A1 Jun. 12, 2003

(30) Foreign Application Priority Data

Jul. 6, 2001 (JP) ..... 2001-206177

(51) Int. Cl.
*A63B 37/06* (2006.01)

(52) U.S. Cl. ..... 473/373; 473/374

(58) Field of Classification Search ..... 473/373, 473/374, 378, 365

See application file for complete search history.

(56) References Cited

U.S. PATENT DOCUMENTS 5,252,652 A * 10/1993 Egashira et al. ..... 524/392
5,830,085 A * 11/1998 Higuchi et al. ..... 473/373
5,971,870 A * 10/1999 Sullivan et al. ..... 473/373
6,152,835 A * 11/2000 Sullivan et al. ..... 473/373
6,325,730 B1 * 12/2001 Binette et al. ..... 473/377

FOREIGN PATENT DOCUMENTS

| | | | |
|---|---|---|---|
| GB | 2 342 295 | A | 4/2000 |
| JP | 9-313643 | A | 12/1997 |
| JP | 2000-107327 | A | 4/2000 |
| JP | 2000-300695 | A | 10/2000 |

* cited by examiner

*Primary Examiner*—Glenn Caldarola
*Assistant Examiner*—Tom P Duong

(57) ABSTRACT

The present invention provides a multi-piece solid golf ball, of which flight performance is improved while maintaining excellent durability and good shot feel. The present invention relates to a multi-piece solid golf ball comprising a core, at least one layer of an inner cover formed on the core and an outer cover covering the inner cover, wherein a surface hardness in JIS-C hardness of the core is higher than a center hardness in JIS-C hardness of the core by not less than 25, a hardness in JIS-C hardness of the inner cover is higher than the surface hardness of the core by less than 15, and a hardness in JIS-C hardness of the outer cover is higher than the hardness of the inner cover by not less than 5.

19 Claims, 1 Drawing Sheet

MULTI-PIECE SOLID GOLF BALL

FIELD OF THE INVENTION

The present invention relates to a multi-piece solid golf ball. More particularly, it relates to a multi-piece solid golf ball, of which flight performance is improved while maintaining excellent durability and good shot feel.

BACKGROUND OF THE INVENTION

In golf balls commercially selling, there are solid golf balls such as two-piece golf ball, three-piece golf ball and the like, and thread wound golf balls. Recently, the two-piece golf ball and three-piece golf ball, of which flight distance can be improved while maintaining soft and good shot feel at the time of hitting as good as the conventional thread wound golf ball, generally occupy the greater part of the golf ball market. Multi-piece golf balls represented by the three-piece golf ball have good shot feel while maintaining excellent flight performance, because they can vary hardness distribution, when compared with the two-piece golf ball.

The golf balls comprising a two-piece core, formed by placing an intermediate layer between the core and the cover of the two-piece solid golf ball, are suggested in Japanese Patent Kokai publication Nos. 239068/1997, 313643/1997, 107327/2000, 271249/2000, 296187/2000, 300695/2000 and the like. In the golf balls, it is attempted to improve both the flight performance and shot feel by using thermoplastic resin, such as polyurethane-based thermoplastic elastomer, ionomer resin or mixtures thereof, for the intermediate layer, and adjusting the hardness or hardness distribution, deformation amount, specific gravity and the like of the core, intermediate layer and cover.

In Japanese Patent Kokai Publication No. 239068/1997, a three-piece solid golf ball comprising a core, an intermediate layer and a cover is described. The core has a central point hardness in JIS-C hardness of not more than 75 and a surface hardness in JIS-C hardness of not more than 85, the surface hardness of the core is higher than the central point hardness of the core by 8 to 20, the hardness of the intermediate layer is higher than that of the surface of the core by not less than 5. The hardness of the cover is lower than that of the intermediate layer by not less than 5, and a ratio of dimple area to surface area of the golf ball is not less than 62%.

In Japanese Patent Kokai Publication No. 313643/1997, a three-piece solid golf ball, of which an intermediate layer is placed between a core and a cover, is described. The core has a central point hardness in JIS-C hardness of not more than 75 and has a surface hardness in JIS-C hardness of not more than 85, the surface hardness is higher than the central point hardness by 5 to 25, a hardness of the intermediate layer is higher than the surface hardness of the core by less than 10, and a hardness of the cover is higher than the hardness of the intermediate layer. In the two above golf balls, since the hardness difference in the core is small, the deformation amount at the time of hitting is small and spin amount is increased, and the flight performance is not sufficiently obtained.

In Japanese Patent Kokai publication No. 107327/2000, a three-piece solid golf ball comprising a core composed of a center having a diameter 27 to 37 mm and an intermediate layer covering the center, and a cover covering the core. The specific gravity of the center (a) is smaller than that of the intermediate layer (b), a surface hardness in JIS-C hardness of the center (Y) is higher than a central point hardness in JIS-C hardness of the center (X) by not less than 8, a surface hardness of the core (Z) is not less than 80, a difference (p−q) between a deformation amount of the center (p) and that of the core (q), when applying from an initial load of 98 N to a final load of 1275 N, is not less than 5, and Shore D hardness of the cover is not more than 60.

In Japanese Patent Kokai publication No. 271249/2000, a three-piece solid golf ball comprising a core composed of an inner core and an outer core, and at least one layer of an cover formed on the core. The inner core has a diameter of 30 to 39.5 mm and a central point hardness in JIS-C hardness of 55 to 70, a JIS-C hardness at the distance of 15 mm from the center point is higher than the central point hardness by 5 to 20, the inner core is formed from heat molded article of rubber composition comprising polybutadiene, co-crosslinking agent, organic peroxide and filler as an essential component; the outer core has a thickness of 0.3 to 2.0 mm and a surface hardness in JIS-C hardness of 75 to 90, the surface hardness is higher than the central point hardness of the inner core by 10 to 35, the outer core is formed from heat molded article of rubber composition, the cover comprises thermoplastic resin as a base resin; and the outmost layer of the cover has a thickness of 1.5 to 2.5 mm and surface hardness in Shore D hardness of 64 to 72. In the two above golf balls, since the intermediate layer is formed from rubber composition, the durability is not sufficiently obtained.

In Japanese Patent Kokai publication No. 296187/2000, a three-piece solid golf ball comprising a center, an intermediate layer formed on the center, and an outer layer covering the intermediate layer. The center has a central point hardness in JIS-C hardness of 55 to 75 and a surface hardness in JIS-C hardness of 65 to 85, and the surface hardness of the center is higher than the central point hardness of the center by 10 to 20, a JIS-C hardness of the intermediate layer is higher than the surface hardness of the center by 10 to 20, and a JIS-C hardness of the outer layer is higher than the hardness of the intermediate layer by 5 to 15. In the golf ball, since the hardness difference in the core is small, the deformation amount at the time of hitting is small and the spin amount is increased, and the flight performance is not sufficiently obtained.

In Japanese Patent Kokai publication No. 300695/2000, a three-piece solid golf ball comprising a core composed of an inner core and an outer core, and at least one layer of an cover formed on the core. The inner core has a diameter of 30 to 40.4 mm and a surface hardness in JIS-C hardness of 60 to 85, a central point hardness in JIS-C hardness of the inner core is lower than the surface hardness by 5 to 30; the outer core has a thickness of 0.2 to 1.3 mm, and a surface hardness in JIS-C hardness of the outer core is lower than the surface of the inner core by 2 to 30. In the golf ball, since the surface hardness of the outer core is lower than the surface hardness of the inner core, the flight performance is not sufficiently obtained.

Many conventional golf balls other than the above golf balls have been proposed. However, in the golf balls, its hardness difference in the core is not optimized, and golf balls having both excellent flight performance and good shot feel, and having the durability for practical use, have not been sufficiently obtained. Therefore, it is required to provide a golf ball having better shot feel, better flight performance and better durability.

OBJECTS OF THE INVENTION

A main object of the present invention is to provide a multi-piece solid golf ball, of which flight performance is improved while maintaining excellent durability and good shot feel.

According to the present invention, the object described above has been accomplished by adjusting the hardness difference of the core, and hardness distribution between each layer and the contiguous layer in the golf ball to specified ranges, thereby providing a multi-piece solid golf ball, of which flight performance is improved while maintaining excellent durability and good shot feel.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
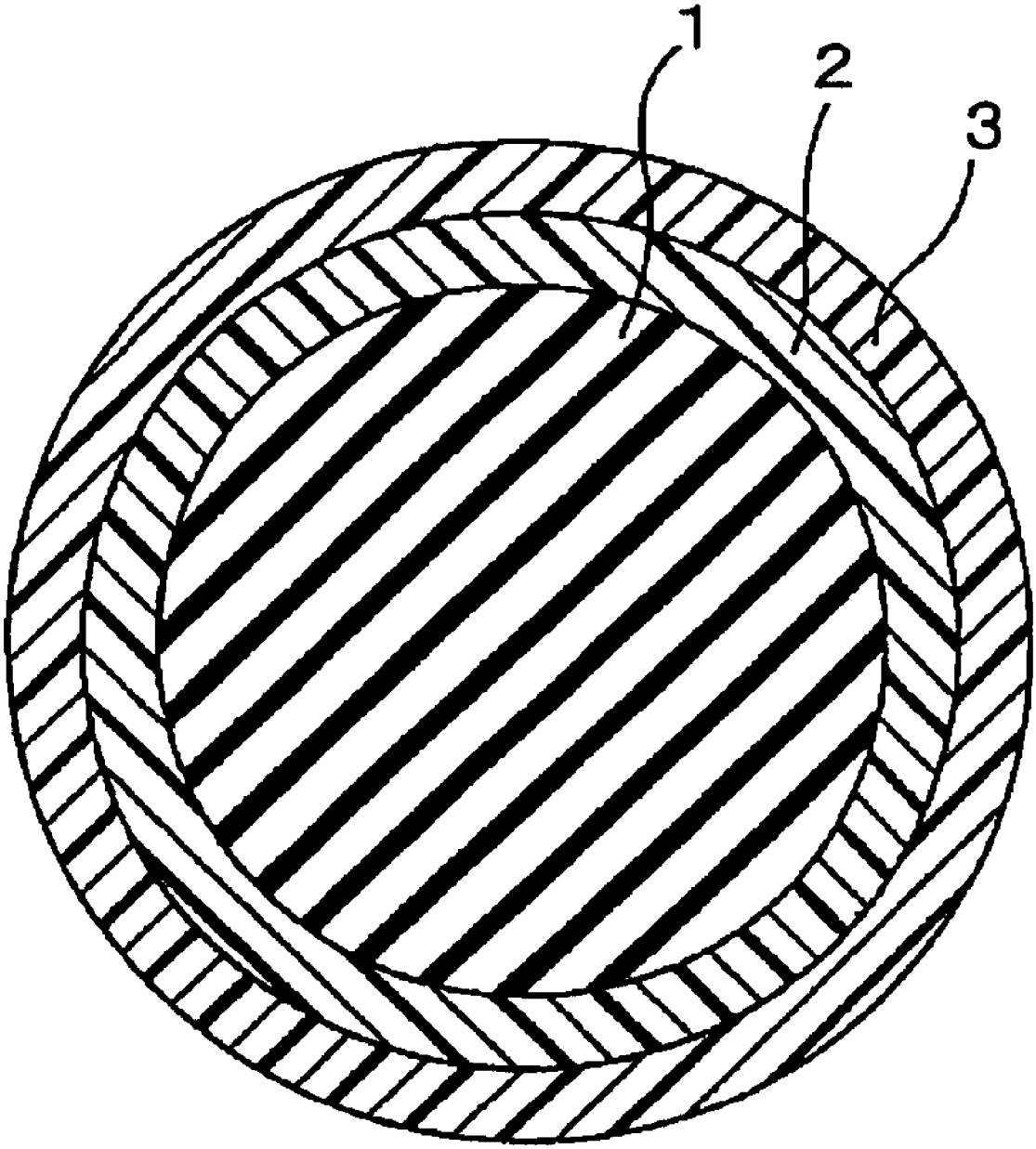
FIG. 1 is a schematic cross section illustrating one embodiment of the golf ball of the present invention.

The present invention provides a multi-piece solid golf ball comprising a core, at least one layer of an inner cover formed on the core and an outer cover covering the inner cover, wherein

- a surface hardness in JIS-C hardness of the core is higher than a center hardness in JIS-C hardness of the core by not less than 25,
- a hardness in JIS-C hardness of the inner cover is higher than the surface hardness of the core by less than 15, and
- a hardness in JIS-C hardness of the outer cover is higher than the hardness of the inner cover by not less than 5.

In the conventional golf balls, the shot feel and flight performance have been improved by adjusting the hardness in the core to a proper range. In order to obtain soft and good shot feel, it is the most effective to increase the hardness difference between the center point and surface of the core. When the hardness difference is large, the deformation amount at the time of hitting is large, and the launch angle is large and the spin amount is restrained. Therefore, the flight performance is improved. However, since the deformation amount at the time of hitting is large, the rebound characteristics are degraded. In the golf ball of the present invention, the rebound characteristics are improved maintaining good shot feel by optimizing the hardness distribution, such that the hardness of the core, inner cover and outer cover respectively is higher in the order.

In order to put the present invention into a more suitable practical application, it is preferable that

- the outer cover have a hardness in JIS-C hardness of not less than 85;
- the core have a deformation amount of 3.0 to 6.0 mm, when applying from an initial load of 98 N to a final load of 1275 N;
- the core be formed from rubber composition comprising 0.01 to 0.5 parts by weight of sulfur;
- at least one layer of the inner cover comprise a base resin containing ionomer resin as a main component, and comprise 5 to 50 parts by weight of thermoplastic elastomer, based on 100 parts by weight of the base resin; and
- the core have the center hardness in JIS-C hardness of lower than 55.

DETAILED DESCRIPTION OF THE INVENTION

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 1, at least one layer of an inner cover 2 formed on the core 1, and an outer cover 3 covering the inner cover. In order to explain the golf ball of the present invention simply, a golf ball having one layer of inner cover 2, that is, a three-piece solid golf ball will be used hereinafter for explanation. However, the golf ball of the present invention may be also applied for the golf ball having two or more layers of the inner cover. The core is obtained by press-molding a rubber composition under applied heat by using a method and condition, which has been conventionally used for preparing solid cores of golf balls. The rubber composition contains polybutadiene, a co-crosslinking agent, an organic peroxide, optionally a filler, an antioxidant, an organic sulfide compound and the like.

The polybutadiene used for the core of the present invention may be one, which has been conventionally used for cores of solid golf balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent can be α,β-unsaturated carboxylic acids having 3 to 8 carbon atoms (e.g. acrylic acid, methacrylic acid, etc.) or a metal salt thereof, including mono or divalent metal salts, such as zinc or magnesium salts, or mixtures thereof. Preferred are zinc methacrylate and zinc acrylate. The amount of the co-crosslinking agent is from 10 to 50 parts by weight, preferably from 10 to 45 parts by weight, more preferably 15 to 45 parts by weight, based on 100 parts by weight of the polybutadiene. When the amount of the co-crosslinking agent is smaller than 10 parts by weight, the vulcanization of the core is not sufficiently conducted, and the core is too soft, which degrades the rebound characteristics and durability of the resulting golf ball. On the other hand, when the amount of the co-crosslinking agent is larger than 50 parts by weight, the core is too hard, and the shot feel of the resulting golf ball is poor.

The organic peroxide includes, for example, dicumyl peroxide, 1,1-bis(t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.1 to 3.0 parts by weight, preferably 0.3 to 3.0 parts by weight, more preferably 0.5 to 2.5 parts by weight, based on 100 parts by weight of the polybutadiene. When the amount of the organic peroxide is smaller than 0.1 parts by weight, the vulcanization of the core is not sufficiently conducted. On the other hand, when the amount of the organic peroxide is larger than 3.0 parts by weight, the core is too hard, but the rebound characteristics are not improved. In addition, the shot feel of the resulting golf ball is poor.

In the golf ball of the present invention, the rubber composition for the core may optionally contain sulfur in addition the above components in order to increase the hardness difference in the core. When the sulfur is used in the rubber composition, the mechanism of crosslinking is not apparent, but it is apparent that the hardness nearby the center point is largely degraded while maintaining high surface hardness of the core by vulcanizing at elevated temperature, compared with the conventional rubber composition. Thereby it is possible to increase the hardness difference between the center point and surface of the core. The amount of the sulfur is 0.01 to 0.5 parts by weight, preferably 0.01 to 0.3 parts by weight, more preferably 0.01 to 0.2 parts by weight, based on 100 parts by weight of the polybutadiene. When the amount of the sulfur is smaller than 0.01 parts by weight, the technical effects accomplished by the presence of the sulfur are not sufficiently obtained. On the other hand, when the amount of the sulfur is larger than 0.5 parts by weight, the vulcanization is too slow by the sulfur, and the desired hardness is not sufficiently obtained.

The rubber compositions for the core of the golf ball of the present invention can contain other components, which have been conventionally used for preparing the core of solid golf balls, such as filler (for example, inorganic filler such as zinc oxide, barium sulfate, calcium carbonate; high specific gravity metal powder filler such as tungsten powder, molybdenum powder; and the mixture thereof), antioxidant, organic sulfide compound and the like. If used, the amount of the filler is preferably 1.0 to 50.0 parts by weight, the amount of the antioxidant is preferably 0.1 to 2.0 parts by weight, and the amount of the organic sulfide compound is preferably 0.05 to 0.5 parts by weight, based on 100 parts by weight of the polybutadiene.

The core 1 of the golf ball of the present invention can be obtained by uniformly mixing the rubber composition, and then press-molding and vulcanizing the mixture under applied heat in a mold. The vulcanizing, of which the condition is not limited, is conducted at 140 to 180° C. and 2.8 to 9.8 MPa for 10 to 60 minutes. In order to increase the hardness difference in the core, it is desired to vulcanize the core at as high temperature as possible. If dicumyl peroxide as an organic peroxide is used, it is preferable to vulcanize the core at the temperature of not less than 160° C.

In the golf ball of the present invention, the core 1 has a diameter of 30 to 41 mm, preferably 32 to 40 mm. When the diameter of the core is smaller than 30 mm, the inner cover and outer cover is too thick, and the technical effects accomplished by the presence of the core are not sufficiently obtained, which degrades the rebound characteristics and shot feel. On the other hand, when the diameter of the core is larger than 41 mm, the inner cover and outer cover is thin, the technical effects of absorbing the impact force at the time of hitting accomplished by the presence of the inner cover and outer cover are not sufficiently obtained. Therefore, the shot feel is poor and the durability is degraded.

In the golf ball of the present invention, it is required that a surface hardness in JIS-C hardness of the core 1 be higher than a center hardness in JIS-C hardness of the core 1 by not less than 25, preferably 28 to 50, more preferably 30 to 50, most preferably 32 to 50. When the hardness difference is smaller than 25, the deformation amount at the time of hitting is small, and the spin amount is increased, which degrades the flight performance. In addition, the shot feel is hard and poor.

In the golf ball of the present invention, it is desired for the core 1 to have a surface hardness in JIS-C hardness of 60 to 90, preferably 60 to 85, more preferably 65 to 80. When the surface hardness is lower than 60, the core is too soft, and the rebound characteristics are degraded. On the other hand, when the surface hardness is higher than 90, the core is too hard, and the shot feel is poor.

In the golf ball of the present invention, it is desired for the core 1 to have a center hardness in JIS-C hardness of lower than 55, preferably not less than 30 and lower than 55, more preferably 35 to 50. When the center hardness of the core 1 is not less than 55, the core is too hard, and the shot feel is poor. The term "a surface hardness of the core 1" as used herein refers to the hardness, which is determined by measuring a hardness at the surface of the resulting core. The term "a center hardness of the core 1" as used herein refers to the hardness, which is obtained by cutting the center into two equal parts and then measuring a hardness at the center point in section.

In the golf ball of the present invention, it is desired for the core 1 to have a deformation amount when applying from an initial load of 98 N to a final load of 1275 N of 3.0 to 6.0 mm, preferably 3.5 to 5.5 mm, more preferably 4.0 to 5.0 mm. When the deformation amount of the core is smaller than 3.0 mm, the core is too hard, and it is difficult to deform the core at the time of hitting, which degrades the shot feel of the resulting golf ball. On the other hand, when the deformation amount is larger than 6.0 mm, the core is too soft, and the core excessively deforms at the time of hitting, which degrades the durability. The inner cover 2 is then covered on the core 1.

In the golf ball of the present invention, it is desired for the inner cover 2 to comprise a base resin containing ionomer resin as a main component. The ionomer resin used in the present invention is not limited, but includes a copolymer of ethylene and α,β-unsaturated carboxylic acid, of which at least a portion of carboxylic acid groups is neutralized with metal ion; a terpolymer of ethylene, α,β-unsaturated carboxylic acid and α,β-unsaturated carboxylic acid ester, of which at least a portion of carboxylic acid groups is neutralized with metal ion; or mixtures thereof. Examples of the α,β-unsaturated carboxylic acid in the ionomer, for example, include acrylic acid, methacrylic acid, fumaric acid, maleic acid, crotonic acid and the like. Preferred are acrylic acid and methacrylic acid. Examples of the α,β-unsaturated carboxylic acid ester in the ionomer, for example, include methyl ester, ethyl ester, propyl ester, n-butyl ester and isobutyl ester of acrylic acid, methacrylic acid, fumaric acid, maleic acid and the like. Preferred are acrylic acid esters and methacrylic acid esters. Examples of the metal ions, which neutralizes a portion of carboxylic acid groups of the copolymer or terpolymer, include a sodium ion, a potassium ion, a lithium ion, a magnesium ion, calcium ion, a zinc ion, a barium ion, an aluminum ion, a tin ion, a zirconium ion, a cadmium ion and the like. Preferred are sodium ion, zinc ion, magnesium ion and the like, in view of rebound characteristics, durability and the like.

The ionomer resin is not limited, but examples thereof will be shown by trade names. Examples of the ionomer resin, which is commercially available from Du Pont-Mitsui Polychemicals Co., Ltd., include Hi-milan 1555, Hi-milan 1557, Hi-milan 1605, Hi-milan 1702, Hi-milan 1705, Hi-milan 1706, Hi-milan 1707, Hi-milan 1855 and the like. Examples of the ionomer resins, which is commercially available from Du Pont Co., include Surlyn 8945, Surlyn 9945, Surlyn 6320, Surlyn 8320, Surlyn 9320 and the like. Examples of the ionomer resin, which is commercially available from Exxon Chemical Co., include Iotek 7010, Iotek 8000, and the like. The ionomers may each be used alone or in combinations of two or more.

In the golf ball of the present invention, it is desired for the inner cover composition to comprise the above ionomer resin as a main component, and to comprise at least one thermoplastic elastomer in an amount of 5 to 50 parts by weight, preferably 15 to 45 parts by weight, more preferably 25 to 40 parts by weight, based on 100 parts by weight of the base resin for the inner cover. When the amount of the thermoplastic elastomer is smaller than 5 parts by weight, the hardness of the inner cover is too high, and the shot feel is poor. On the other hand, when the amount of the thermoplastic elastomer is larger than 50 parts by weight, the hardness of the inner cover is too low, and the rebound characteristics are degraded, which reduces the flight distance.

Examples of the thermoplastic elastomers include polyamide-based thermoplastic elastomer, which is commercially available from Toray Co., Ltd. under the trade name of "Pebax" (such as "Pebax 2533"); polyester-based thermoplastic elastomer, which is commercially available from Toray-Do Pont Co., Ltd. under the trade name of "Hytrel" (such as "Hytrel 3548", "Hytrel 4047"); polyurethane-based thermoplastic elastomer, which is commercially available from BASF Polyurethane Elastomers Co., Ltd. under the trade name of "Elastollan" (such as "Elastollan ET880"); polyurethane-based thermoplastic elastomer, which is commercially available from Dainippon Ink & Chemicals Inc., Ltd. under the trade name of "Pandex" (such as "Pandex T-8180"); styrene-based thermoplastic elastomer, which is commercially available from Mitsubishi Chemical Co., Ltd. under the trade name of "Rabalon" (such as "Rabalon SR04); and the like. Preferred are polyurethane-based thermoplastic elastomer or styrene-based thermoplastic elastomer.

The composition for the inner cover 2 of the golf ball of the present invention can contain other components, such as filler, pigment, antioxidant and the like, in addition to the base resin comprising the ionomer resin and thermoplastic elastomer as a main component. Examples of the filler include, for example, inorganic filler (such as zinc oxide, barium sulfate, calcium carbonate), high specific gravity metal powder filler (such as tungsten powder, molybdenum powder) and the mixture thereof.

The inner cover 2 of the present invention may be formed by conventional methods, which have been known to the art and used for forming the cover of the golf balls. For example, there can be used a method comprising molding the inner cover composition into a semi-spherical half-shell in advance, covering the core with the two half-shells, followed by pressure molding, or a method comprising injection molding the inner cover composition directly on the core to cover it.

In the golf ball of the present invention, it is required that a hardness in JIS-C hardness of the inner cover 2 be higher than the surface hardness of the core 1 by less than 15, preferably less than 10, more preferably not less than 2 and less than 8. When the hardness difference between the inner cover and the surface of the core is not less than 15, the hardness difference is too large, and the inner cover is much harder than the surface of the core. Therefore, it is difficult for the inner cover to deform at the time of hitting, and the technical effects accomplished by the hardness difference in the core are not sufficiently obtained. On the other hand, when the hardness of the inner cover is lower than the surface hardness of the core, the rebound characteristics are degraded, which reduces the flight distance.

In the golf ball of the present invention, it is desired for the inner cover 2 to have a hardness in JIS-C hardness of 65 to 90, preferably 70 to 90, more preferably 70 to 85. When the hardness of the inner cover is lower than 65, the inner cover is too soft, and the rebound characteristics are degraded. On the other hand, when the hardness of the inner cover is higher than 90, the inner cover is too hard, and the technical effects accomplished by the presence of the core are not sufficiently obtained.

In the golf ball of the present invention, it is desired for the inner cover 2 to have a thickness of 0.5 to 2.5 mm, preferably 0.8 to 2.0 mm, more preferably 0.8 to 1.4 mm. When the thickness of the inner cover is smaller than 0.5 mm, the inner cover is too thin, and the technical effects accomplished by the presence of the inner cover are not sufficiently obtained. Therefore, the flight performance and controllability are degraded. On the other hand, when the thickness is larger than 2.5 mm, the technical effects accomplished by the presence of the core are not sufficiently obtained, and the flight performance and shot feel are degraded. The outer cover 3 is then covered on the inner cover 2.

In the outer cover 3 of the golf ball of the present invention, the ionomer resin, which is the same as used for the inner cover 2, can be used. The ionomer resin may be used alone or in combination. As the materials suitably used for the outer cover 3 of the present invention, the above ionomer resin may be used alone, but the ionomer resin may be used in combination with at least one of thermoplastic elastomer, which is the same as used for the inner cover 2.

In the golf ball of the present invention, the composition for the outer cover 3 may optionally contain fillers (such as barium sulfate, etc.), pigments (such as titanium dioxide, etc.), and other additives (such as a dispersant, an antioxidant, a UV absorber, a photostabilizer and a fluorescent agent or a fluorescent brightener, etc.), in addition to the base resin as a main component, as long as the addition of the additive does not deteriorate the desired performance of the golf ball cover. If used, the amount of the pigment is preferably 0.1 to 5.0 parts by weight, based on the 100 parts by weight of the base resin of the outer cover.

The outer cover 3 of the present invention may be also formed by the conventional method, which is the same as used for the inner cover 2. In the golf ball of the present invention, it is desired for the outer cover 3 to have a thickness of 0.5 to 2.5 mm, preferably 0.8 to 2.0 mm, more preferably 0.8 to 1.6 mm. When the thickness of the outer cover is smaller than 0.5 mm, the outer cover is too thin, and the technical effects accomplished by the presence of the outer cover are not sufficiently obtained. Therefore, the flight performance and durability are degraded. On the other hand, when the thickness is larger than 2.5 mm, the technical effects accomplished by the presence of the core and inner cover are not sufficiently obtained, and the shot feel is poor.

In the golf ball of the present invention, it is required that a hardness in JIS-C hardness of the outer cover be higher than the hardness of the inner cover by not less than 5, preferably not less than 8, more preferably 10 to 25. When the hardness difference between the outer cover and the inner cover is smaller than 5, the hardness of the outer cover is too low, and the rebound characteristics are degraded, or the shot feel is heavy and poor. In addition, the hardness of the inner cover is too high, the technical effects accomplished by the presence of the core are not sufficiently obtained. In addition, the shot feel is hard and poor.

In the golf ball of the present invention, it is desired for the outer cover 3 to have a hardness in JIS-C hardness of not less than 85, preferably 85 to 98, more preferably 88 to 95. When the hardness of the outer cover is lower than 85, the deformation amount at the surface portion of the resulting golf ball at the time of hitting is large even if the hardness of the core is adjusted, and the rebound characteristics are degraded. In addition, the shot feel is heavy and poor. The terms "a hardness of the inner cover 2" and "a hardness of the outer cover 3" as used herein refer to the hardness (slab hardness), which is measured by using a sample of a stack of the three or more heat and press molded sheets having a thickness of about 2 mm prepared from each cover composition, which had been stored at 23° C. for 2 weeks.

At the time of molding the outer cover, many depressions called "dimples" are formed on the surface of the golf ball. Furthermore, paint finishing or marking with a stamp may be optionally provided after the outer cover is molded.

EXAMPLES

The following Examples and Comparative Examples further illustrate the present invention in detail but are not to be construed to limit the scope of the present invention.

Production of Core

The rubber compositions for the core having the formulations shown in Table 1 were mixed with a mixing roll, and then vulcanized by press-molding in the mold at the condition shown in Table 4 (Examples) and Table 5 (Comparative Examples) to obtain spherical cores having a diameter of 36.0 mm. The center hardness (a), surface hardness (b) and deformation amount of the resulting core were measured, and the hardness difference (b−a) was determined by calculation. The results are shown in the same Tables. The test methods are described later.

TABLE 1

(parts by weight)

| Core composition | | I | II | III |
|---|---|---|---|---|
| BR-11 | *1 | 100 | 100 | 100 |
| Zinc acrylate | | 27 | 29 | 24 |
| Zinc oxide | | 10 | 10 | 10 |
| Dicumyl peroxide | | 0.8 | 0.8 | 0.8 |
| Diphenyl disulfide | | 0.5 | 0.5 | 0.5 |
| Sulfur | | 0.05 | 0.05 | — |
| Barium sulfate | (*) | Proper amount | Proper amount | Proper amount |

*1: High-cis Polybutadiene rubber (trade name "BR11") available from JSR Co., Ltd. (Content of 1,4-cis-polybutadiene: 96%)
(*) The amount of barium sulfate was adjusted to a proper amount such that the weight of the resulting golf ball was 45.4 g.

Preparation of Compositions for Inner Cover and Outer Cover

The formulation materials for the inner cover showed in Table 2 and formulation materials for the outer cover showed in Table 3 were respectively mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C. at the die position of the extruder. The inner cover hardness (c) and the outer cover hardness (d) were determined by measuring a hardness, using a sample of a stack of the three or more heat and press molded sheets having a thickness of about 2 mm from the resulting composition for each cover, which had been stored at 23° C. for 2 weeks, with a JIS-C hardness meter according to JIS K 6301. The results are shown in Table 2 (inner cover), Table 3 (outer cover), Table 4 (Examples) and Table 5 (Comparative Examples), respectively. The values of hardness difference (c−b) and (d−c) were determined by calculation. The results are shown in Table 4 (Examples) and Table 5 (Comparative Examples). The test methods are described later.

TABLE 2

(parts by weight)

| Inner cover composition | | A | B | C | D | E |
|---|---|---|---|---|---|---|
| Hi-milan 1605 | *2 | 40 | 35 | 45 | 10 | 10 |
| Hi-milan 1706 | *3 | 40 | 35 | 45 | — | — |
| Hi-milan 1855 | *4 | — | — | — | — | 80 |
| Hi-milan AM7316 | *5 | — | — | 10 | — | 10 |
| Hytrel 3548 | *6 | — | 30 | — | — | — |
| Elastollan ET880 | *7 | — | — | — | 90 | — |
| Rabalon SR04 | *8 | 20 | — | — | — | — |
| Hardness (JIS-C) | | 81 | 83 | 90 | 50 | 81 |

TABLE 3

(parts by weight)

| Outer cover composition | | X | Y | Z |
|---|---|---|---|---|
| Hi-milan 1605 | *2 | 50 | 35 | 10 |
| Hi-milan 1706 | *3 | 50 | 35 | 10 |
| Hi-milan 1855 | *4 | — | 30 | 80 |
| Titanium dioxide | | 2 | 2 | 2 |
| Barium sulfate | | 2 | 2 | 2 |
| Hardness (JIS-C) | | 93 | 90 | 84 |

*2: Hi-milan 1605 (trade name), ethylene-methacrylic acid copolymer ionomer resin obtained by neutralizing with sodium ion, manufactured by Du Pont Mitsui Polychemicals Co., Ltd.
*3: Hi-milan 1706 (trade name), ethylene-methacrylic acid copolymer ionomer resin obtained by neutralizing with zinc ion, manufactured by Du Pont Mitsui Polychemicals Co., Ltd.
*4: Hi-milan 1855 (trade name), ethylene-methacrylic acid-acrylic acid ester terpolymer ionomer resin obtained by neutralizing with zinc ion, manufactured by Du Pont Mitsui Polychemicals Co., Ltd.
*5: Hi-milan AM7316 (trade name), ethylene-methacrylic acid-acrylic acid ester terpolymer ionomer resin obtained by neutralizing with zinc ion, manufactured by Du Pont Mitsui Polychemicals Co., Ltd.
*6: Hytrel 3548 (trade name), polyester-based thermoplastic elastomer, which is commercially available from Toray-Du Pont Co., Ltd.
*7: Elastollan ET880 (trade name), polyurethane-based thermoplastic elastomer, which is commercially available from BASF Polyurethane Elastomers Ltd.
*8: Rabalon SR04 (trade name), which is commercially available from Mitsubishi Chemical Co., Ltd.

Formation of Inner Cover

The resulting composition for the inner cover was injection-molded on the core to form an inner cover having a thickness of 1.6 mm.

Examples 1 to 3 and Comparative Examples 1 to 5

The resulting composition for the outer cover was covered on the inner cover by injection molding using a mold having dimples for golf ball to form an outer cover layer having a thickness of 1.8 mm. Then, paint was applied on the surface to obtain golf ball having a diameter of 42.8 mm and weight of 45.4 g. The coefficient of restitution, flight distance, durability and shot feel of the resulting golf balls were measured or evaluated. The results are shown in Table 4 (Examples) and Table 5 (Comparative Examples). The test methods are as follows.

(Test Method)

(1) Hardness (i) Core Hardness

The surface hardness of the core is determined by measuring JIS-C hardness at the surface of the resulting core. The center hardness of the core is determined by measuring JIS-C hardness at the center point of the core in section, after the core is cut into two equal parts. The JIS-C hardness was measured with a JIS-C hardness meter according to JIS K 6301.

(ii) Inner Cover and Outer Cover Hardness

The hardness of the inner cover or outer cover was determined by measuring a hardness, using a sample of a stack of the three or more heat and press molded sheets having a thickness of about 2 mm from each cover composition, which had been stored at 23° C. for 2 weeks, with a JIS-C hardness meter according to JIS K 6301.

(2) Deformation Amount

The deformation amount of core was determined by measuring a deformation amount when applying from an initial load of 98 N to a final load of 1275 N on the core.

(3) Coefficient of Restitution

A cylindrical aluminum projectile having weight of 200 g was struck at a speed of 40 m/sec against a golf ball, and the velocity of the projectile and the golf ball before and after the strike were measured. The coefficient of restitution of the golf ball was calculated from the velocity and the weight of both the projectile and the golf ball. The measurement was conducted by using 12 golf balls for each sample (n=12), with the mean value being taken as the coefficient of restitution of each ball and expressed as an index, with the value of the index in Comparative Example 1 being taken as 1. A higher index corresponded to a higher rebound characteristic, and thus a good result.

(4) Flight Distance

A No. 1 wood club (W#1, a driver) having metal head was mounted to a swing robot manufactured by True Temper Co. and the resulting golf ball was hit at a head speed of 40 m/sec, the flight distance was measured. As the flight distance, total that is a distance to the stop point of the hit golf ball was measured. The measurement was conducted 5 times for each golf ball (n=5), and the average is shown as the result of the golf ball.

(5) Durability

A No.1 wood club (W#1, a driver) having metal head was mounted to a swing robot manufactured by True Temper Co. and the resulting golf ball was hit at a head speed of 45 m/second to strike against an impact board, repeatedly. The durability is determined by measuring the number of hit until the cover of the golf ball cracks, and is expressed as an index, with the value of the index in Comparative Example 1 being taken as 100. The larger the value is, the better durability the golf ball has.

(6) Shot Feel (i) Shot Feel (Impact)

The shot feel of the resulting golf ball was evaluated by 10 golfers according to practical hitting test using a No. 1 wood club (W#1, a driver). The evaluation criteria are as follows.

(Evaluation Criteria)

○○: Not less than 8 golfers out of 10 golfers felt that the golf ball has good shot feel such that the impact force at the time of hitting is small.

○: Six to 7 golfers out of 10 golfers felt that the golf ball has good shot feel such that the impact force at the time of hitting is small.

Δ: Four to 5 golfers out of 10 golfers felt that the golf ball has good shot feel such that the impact force at the time of hitting is small.

x: Not more than 3 golfers out of 10 golfers felt that the golf ball has good shot feel such that the impact force at the time of hitting is small.

(ii) Shot Feel (Rebound)

The shot feel of the resulting golf ball was evaluated by 10 golfers according to practical hitting test using a No. 1 wood club (W#1, a driver). The evaluation criteria are as follows.

(Evaluation Criteria)

○○: Not less than 8 golfers out of 10 golfers felt that the golf ball has good shot feel such that the rebound characteristics is good.

○: Six to 7 golfers out of 10 golfers felt that the golf ball has good shot feel such that the rebound characteristics is good.

Δ: Four to 5 golfers out of 10 golfers felt that the golf ball has good shot feel such that the rebound characteristics is good.

x: Not more than 3 golfers out of 10 golfers felt that the golf ball has good shot feel such that the rebound characteristics is good.

TABLE 4

| Test item | | Example No. 1 | 2 | 3 |
|---|---|---|---|---|
| (Core) | | | | |
| Composition | | I | II | I |
| Vulcanization condition | | | | |
| The first stage | Temp (° C.) | 170 | 170 | 170 |
| | Time (min) | 25 | 25 | 25 |
| The second stage | Temp (° C.) | — | — | — |
| | Time (min) | — | — | — |
| Center hardness | (a) (JIS-C) | 48 | 50 | 53 |
| Surface hardness | (b) (JIS-C) | 76 | 78 | 81 |
| Hardness difference (b − a) | | 28 | 28 | 28 |
| Deformation amount (mm) | | 4.7 | 4.2 | 3.9 |
| (Inner cover) | | | | |
| Composition | | B | A | B |
| Hardness (c) (JTS-C) | | 83 | 81 | 83 |
| Hardness difference (c − b) | | 7 | 3 | 2 |
| (Outer cover) | | | | |
| Composition | | X | X | Y |
| Hardness (d) (JIS-C) | | 93 | 93 | 90 |
| Hardness difference (d − c) | | 10 | 12 | 7 |
| Physical properties of the golf ball | | | | |
| Coefficient of restitution | | 1.01 | 1.02 | 1.01 |
| Flight distance (m) | | 178 | 180 | 179 |
| Durability | | 100 | 110 | 115 |
| Shot feel (Impact) | | ○○ | ○○ | ○○ |
| Shot feel (Rebound) | | ○○ | ○○ | ○○ |

TABLE 5

| Test item | | Comparative Example No. 1 | 2 | 3 | 4 | 5 |
|---|---|---|---|---|---|---|
| (Core) | | | | | | |
| Composition | | III | I | III | II | II |
| Vulcanization condition | | | | | | |
| The first stage | Temp (° C.) | 160 | 170 | 144 | 170 | 170 |
| | Time (min) | 25 | 25 | 25 | 25 | 25 |

TABLE 5-continued

| Test item | | Comparative Example No. 1 | 2 | 3 | 4 | 5 |
|---|---|---|---|---|---|---|
| The second stage | Temp (° C.) | — | — | 165 | — | — |
| | Time (min) | — | — | 8 | — | — |
| Center hardness | (a) (JIS-C) | 56 | 48 | 72 | 50 | 50 |
| Surface hardness | (b) (JIS-C) | 72 | 76 | 76 | 78 | 78 |
| Hardness difference (b − a) | | 16 | 28 | 4 | 28 | 28 |
| Deformation amount (mm) | | 4.5 | 4.7 | 4.2 | 4.2 | 4.2 |
| (Inner cover) | | | | | | |
| Composition | | E | C | A | D | A |
| Hardness (c) (JIS-C) | | 81 | 90 | 81 | 50 | 81 |
| Hardness difference (c − b) | | 9 | 14 | 5 | −28 | 3 |
| (Outer cover) | | | | | | |
| Composition | | X | X | X | X | Z |
| Hardness (d) (JIS-C) | | 93 | 93 | 93 | 93 | 84 |
| Hardness difference (d − c) | | 12 | 3 | 12 | 43 | 3 |
| Physical properties of the golf ball | | | | | | |
| Coefficient of restitution | | 1 | 1.02 | 1.02 | 0.98 | 0.99 |
| Flight distance (m) | | 176 | 180 | 178 | 175 | 176 |
| Durability | | 100 | 98 | 110 | 105 | 115 |
| Shot feel (Impact) | | ○ | x | Δ | ○○ | ○○ |
| Shot feel (Rebound) | | ○○ | ○○ | ○○ | Δ | ○ |

As is apparent from Tables 4 and 5, the golf balls of Examples 1 to 3 of the present invention, when compared with the golf balls of Comparative Examples 1 to 5, had excellent flight performance while maintaining excellent durability and good shot feel.

On the other hand, in the golf ball of Comparative Example 1, since the hardness difference (b−a) between the center hardness (a) and surface hardness (b) of the core is small, the deformation amount at the time of hitting is small and the spin amount is increased, which reduces the flight distance. In the golf ball of Comparative Example 2, since the hardness difference (d−c) between the outer cover hardness (d) and inner cover hardness (c) is small, the outer cover hardness value (d) approximates the inner cover hardness value (c), and the impact force at the time of hitting is large, which largely degrades the shot feel.

In the golf ball of Comparative Example 3, since the hardness difference (b−a) is small, the deformation amount at the time of hitting is small, and the impact force at the time of hitting is large, which degrades the shot feel. In the golf ball of Comparative Example 4, since the inner cover hardness is not more than the surface hardness of the core, the coefficient of restitution is small, which reduces the flight distance. In addition, the shot feel is heavy and poor such that the rebound characteristics are poor.

In the golf ball of Comparative Example 5, since the hardness difference (d−c) is small, the outer cover hardness value (d) approximates the inner cover hardness value (c), and the shot feel is heavy and poor such that the rebound characteristics are slightly poor. In addition, the outer cover hardness is low, and the coefficient of restitution is small, which reduces the flight distance.

What is claimed is:

1. A multi-piece solid golf ball comprising a core, at least one layer of an inner cover formed on the core and an outer cover covering the inner cover, wherein a surface hardness in JIS-C hardness of the core is higher than a center hardness in JIS-C hardness of the core by not less than 28, a hardness in JIS-C hardness of the inner cover is higher than the surface hardness of the core by less than 15, a hardness in JTS-C hardness of the outer cover is higher than the hardness of the inner cover by not less than 5, and wherein the core is formed from a rubber composition comprising 0.01 to 0.5 parts by weight of sulfur.

2. The multi-piece solid golf ball according to claim 1, wherein the outer cover has a hardness in JIS-C hardness of not less than 85.

3. The multi-piece solid golf ball according to claim 1, wherein the core has a deformation amount of 3.0 to 6.0 mm, when applying from an initial load of 98 N to a final load of 1275 N.

4. The multi-piece solid golf ball according to claim 1, wherein at least one layer of the inner cover comprises a base resin containing ionomer resin as a main component, and comprises 5 to 50 parts by weight of thermoplastic elastomer, based on 100 parts by weight of the base resin.

5. The multi-piece solid golf ball according to claim 1, wherein the core has the center hardness in JIS-C hardness of lower than 55.

6. The multi-piece solid golf ball according to claim 1, wherein the surface hardness in JIS-C hardness of the core is higher than a center hardness in JIS-C hardness of the core by not less than 28.

7. The multi-piece solid golf ball according to claim 1, wherein the surface hardness in JIS-C hardness of the core is higher than a center hardness in JIS-C hardness of the core by 28 to 50.

8. The multi-piece solid golf ball according to claim 1, wherein the surface hardness in JIS-C hardness of the core is higher than a center hardness in JIS-C hardness of the core by 32–50.

9. The multi-piece solid golf ball according to claim 1, wherein the core has a center hardness in JIS-C hardness of 35 to 50.

10. The multi-piece solid golf ball according to claim 1, wherein the core has a surface hardness in JIS-C hardness of 60 to 90.

11. The multi-piece solid golf ball according to claim 1, wherein the core has a surface hardness in JIS-C hardness of 65–80.

12. The multi-piece solid golf ball according to claim 1, wherein the core is formed from a rubber composition comprising 0.01 to 0.3 parts by weight of sulfur.

13. The multi-piece solid golf ball according to claim 1, wherein the core is formed from a rubber composition comprising 0.01 to 0.2 parts by weight of sulfur.

14. The multi-piece solid golf ball according to claim 1, wherein the hardness in JIS-C hardness of the inner cover is higher than the surface hardness of the core by less than 10.

15. The multi-piece solid golf ball according to claim 1, wherein the hardness in JIS-C hardness of the inner cover is higher than the surface hardness of the core by not less than 2 and less than 8.

16. The multi-piece solid golf ball according to claim 1, wherein the inner cover has a hardness in JIS-C hardness of 65 to 90.

17. The multi-piece solid golf ball according to claim 1, wherein the inner cover has a hardness in JIS-C hardness of 70 to 85.

18. The multi-piece solid golf ball according to claim 1, wherein the outer cover has a hardness in JIS-C hardness of not less than 85 to 98.

19. The multi-piece solid golf ball according to claim 1, wherein the outer cover has a hardness in JIS-C hardness of not less than 88 to 95.

* * * * *